US006152011A

United States Patent [19]

Ivy et al.

[11] Patent Number: 6,152,011

[45] Date of Patent: Nov. 28, 2000

[54] SYSTEM FOR CONTROLLING AND INDEPENDENTLY FIRING MULTIPLE MISSILES OF DIFFERENT TYPES

[75] Inventors: Robert Leon Ivy, Jarrettsville; George Henry Goetz, Joppa; Timothy John Preston, Bel Air, all of Md.

[73] Assignee: Lockheed Martin Corp., Moorestown, N.J.

[21] Appl. No.: 09/014,344

[22] Filed: Jan. 27, 1998

[51] Int. Cl.[7] ..... F41F 3/055; F41F 3/077; F41F 3/052

[52] U.S. Cl. ..... 89/1.814; 102/217; 89/1.807; 89/1.811; 89/1.817

[58] Field of Search ..... 102/217; 89/1.807, 89/1.811, 1.814, 1.817, 1.8

[56] References Cited

U.S. PATENT DOCUMENTS

| | | | |
|---|---|---|---|
| 3,779,129 | 12/1973 | Lauro | 89/1.814 |
| 3,884,118 | 5/1975 | Taylor et al. | 89/1.807 |
| 4,324,168 | 4/1982 | Sano et al. | 89/1.814 |
| 4,359,926 | 11/1982 | Sano et al. | 89/1.814 |
| 5,351,597 | 10/1994 | Holmstrom et al. | 89/1.814 |
| 5,877,696 | 3/1999 | Powell | 89/1.8 |

FOREIGN PATENT DOCUMENTS

| | | | |
|---|---|---|---|
| 3427165 | 1/1986 | Germany | 89/1.814 |
| 3152397 | 6/1991 | Japan | 89/1.817 |

OTHER PUBLICATIONS

Webster; Webster's Dictionary; p. 1857, 1996.

*Primary Examiner*—Stephen M. Johnson
*Attorney, Agent, or Firm*—W. H. Meise; S. D. Weinstein

[57] ABSTRACT

A launch system for plural missiles of different types includes plural launch locations, each adapted for receiving a canisterized missile having a standardized connector, which is coded to indicate the missile type contained within the canister. The system includes an individual fire control unit for each launch location or cell, and power supplies which are available to groups of such cells. An local-area network (LAN), such as Ethernet, interconnects the power supplies, the fire control units, and a central launch control system. Each fire control unit includes a processor for determining the missile type with which it is associated, and an interface card for each different missile type which may be used. The fire control units respond to commands from the central launch control system by interpreting the commands into a parallel form understandable by the missile interface cards. The missile interface cards transform the parallel data into serial data in a format suitable to the missile type being handled in the cell. Ancillary commands, such as launch hatch position and power-supply ON-OFF commands, are carried over the LAN.

7 Claims, 2 Drawing Sheets

SYSTEM FOR CONTROLLING AND INDEPENDENTLY FIRING MULTIPLE MISSILES OF DIFFERENT TYPES

FIELD OF THE INVENTION

This invention relates to missile launch systems, and more particularly to missile launch systems for launching any one of a number of standardized missiles from any one of a plurality of missile launch sites.

BACKGROUND OF THE INVENTION

Modern warship weapon systems rely to a great extent on powered missiles. For this purpose, some warships carry a plurality of missiles, which may be of different types. For convenience, common launchers may be used for these different missile types. Some missiles come from the manufacturer encased in a protective container or canister, at least a part of which becomes part of the launcher. Each missile-bearing canister fits into the common launcher, and has a standardized canister connector by which signals can be coupled between the missile within the canister and the outside world. The canister connector is coded by the manufacturer, by interconnecting or jumpering certain pins, to identify the missile within, to avoid the possibility of human error in programming the missile. The standardized canister connector is connected by a standardized umbilical cable, which in one version contains 145 conductors, with a launch-control sequencer. Each launch-control sequencer controls the arming and firing of those missiles which are in canisters located in missile launch locations or bays connected to that launch-control sequencer. For example, a launch-control sequencer may be connected to eight launch bays, and thus may be capable of controlling the arming and firing of up to eight missiles. After firing, the bays can be reloaded with new missile canisters.

A central launch control unit, given a command to arm and fire a particular type of missile toward a particular target, provides the commands to a launch-control sequencer associated with a particular group of missile launch locations. As mentioned, the locations may contain different types of missiles. When a missile is to be launched by a launch-control sequencer, the sequencer selects a missile of the type to be launched from among those assigned to it, and, using instructions stored in memory, goes through the appropriate arming sequence. Following the arming sequence, the launch-control sequencer waits for a launch command, and then translates a received launch command, if any, and sends the translated launch command to the selected missile.

In the system as so far described, if a further target should be identified for immediate destruction during the period when the first missile is being armed, the central launch control unit may command arming and firing of a missile type different from the first one selected. As an example, during the arming sequence for a Tomahawk long-range missile, an anti-aircraft missile may be required. In this situation, the launch-control sequencer must halt the arming sequence of the first missile (the Tomahawk) in order to control the arming and firing of the second (anti-aircraft) missile. The launch-control sequencer can resume the arming of the first missile only after the second missile has been armed and fired. In a hostile environment, the hiatus in the arming and firing of the first missile may be unacceptable.

The described system also has the disadvantage that a change of the characteristics of one of the missiles to be controlled, as by updating a presently used missile, or adding a new missile type, requires reprogramming of the launch sequencer. The reprogrammed sequencer must be extensively tested to assure that the reprogramming has not adversely affected unrelated aspects of the sequencer's performance.

Improved missile launch arrangements are desired.

SUMMARY OF THE INVENTION

A missile launching arrangement according to the invention is capable of launching a plurality of missile types. Each of the missiles is loaded into a canister which has a standardized multipin canister connector (a plug or socket), which standardized canister connector includes pins which are jumpered, internally to the canister, in a manner which provides coding information identifying the type of missile within the canister. The canister connector also includes pins which provide a path for the flow of signals between the missile in the canister and the outside world. The missile launching arrangement includes a launch control system for generating commands which identify the type of missile to be launched, and which also generates missile launch preparation commands and missile launch commands. The missile launch control system may also maintain an inventory of the missile types available to the missile launching arrangement. The arrangement according to the invention also includes a plurality of missile launch locations, each of which is capable of holding one of the missile canisters of any of the plurality of types of missiles. A power supply module is associated with each of the missile launch locations, and each of the power supply modules includes a plurality of switchable voltage sources. A fire control unit is associated with each one of the missile launch locations. Each of the fire control units includes an electronics module and a relay module. The electronics module and the relay module of each fire control unit are connected by continuous electrically conductive paths to the standardized canister connector of that one of the canisters associated with the particular one of the missile launch locations with which the fire control unit is associated. The electronics module of the fire control unit is also connected to the launch control system and to the associated one of the relay modules. Each one of the relay modules is also connected to each one of (to all of) the switchable voltage sources of that one of the power supply modules associated with the associated one of the missile launch locations, for coupling the voltages of a selected set of the switchable voltage sources to the standardized canister connector of that one of the missile canisters located in the associated one of the missile launch locations. The set of voltages which is coupled may be the voltage of only one of the voltage sources, if appropriate to the missile type. Each one of the electronics modules includes a memory arrangement preloaded with information relating to a plurality of individual types of missiles. The electronics module performs a comparison of the memorized information with the coding of that one of the standardized canister connectors associated with that one of the missile canisters associated with the associated missile launch location, for identifying the type of missile contained therein, and for communicating the type of missile so identified to the launch control unit. The launch control unit preferably maintains an inventory of the missile types which are available for launch. Each one of the fire control units also responds to arming and firing commands from the launch control unit directed to the one of the fire control units, by producing, with the aid of that preprogrammed memory associated with its electronics module, a sequence of corresponding arming and firing commands appropriate to the particular missile type identified by the coding of the standardized canister connector.

The corresponding arming and firing commands are coupled to the standardized canister connector of that one of the canisters associated with the associated missile launch location. In a particular embodiment of the invention, the switchable voltage sources of that one of the power supplies or power supply modules associated with a particular one of the missile launch locations are controllable from the electronics module of the fire control unit associated with the same one of the missile launch locations. In this embodiment, the switchable voltage sources are controllable over a local area network which includes the corresponding one of the fire control units. In one embodiment of the invention, the local area network includes connections to all of the fire control units.

DESCRIPTION OF THE INVENTION

Figure 1A:
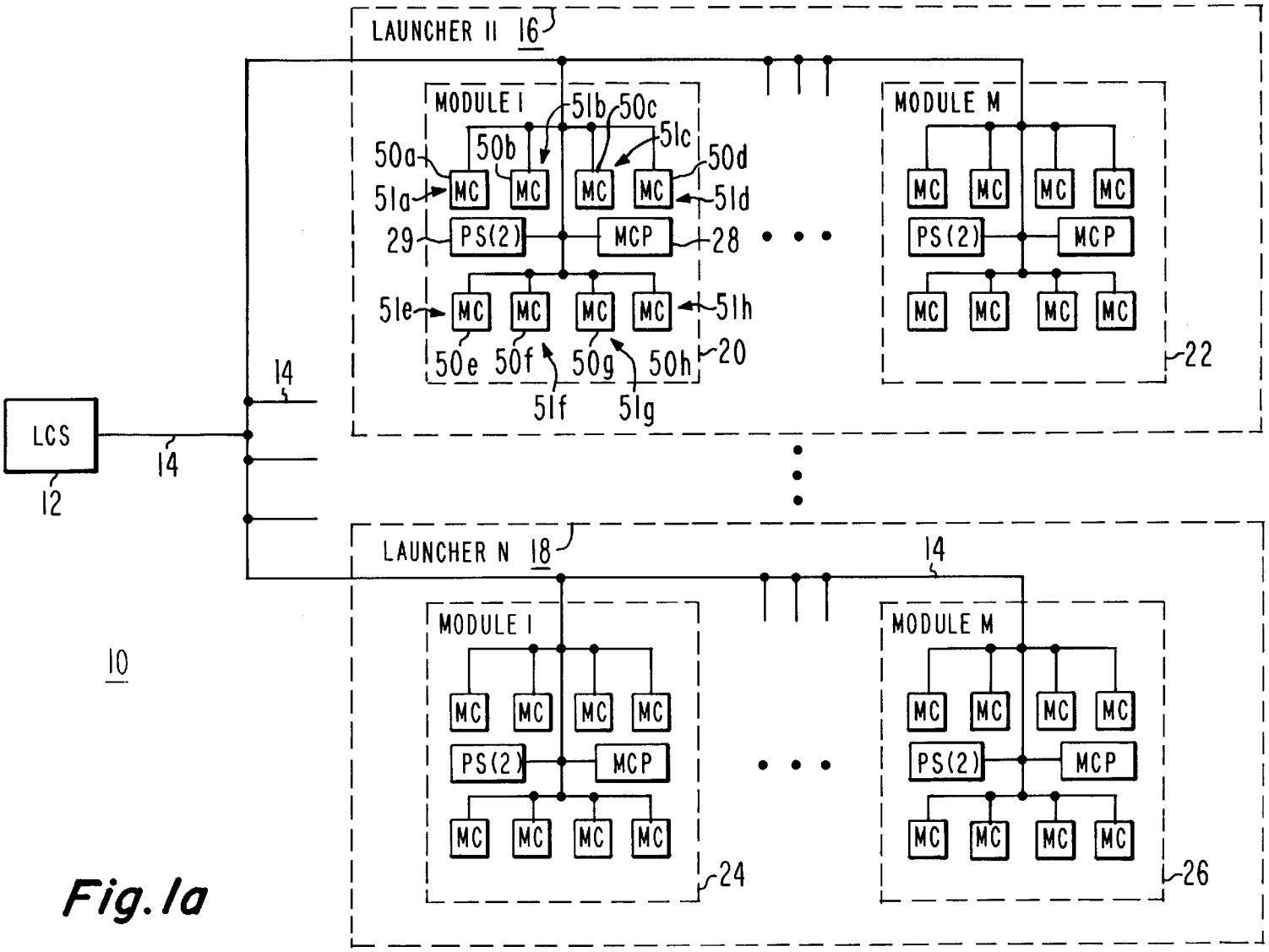
FIG. 1*a* is a simplified block diagram of a multi-missile launching arrangement 10 in accordance with an aspect of the invention.

FIG. 1*a* is a simplified block diagram of a multi-missile launching arrangement 10 in accordance with an aspect of the invention. In FIG. 1*a*, a launch control system (LCS) 12 receives commands from a human, and may also received target location and/or type data from other instruments, such as a radar system. In response to those commands and signals, LCS 12 produces commands on a bus 14 which identify the intended recipient. It should be understood that the block illustrated as LCS 12 may actually include an external weapons control system which performs target identification, tracking and targeting, and may also include common front-end processing for the launcher described below, which provides missile inventory management, control and coordination of the module launch control electronics. The constituent parts (not illustrated) of LCS 12 may be interconnected by means of a local area network separate from the Ethernet LAN described below.

Bus 14 of FIG. 1*a* is part of a local area network, as for example an Ethernet network, by which communications are accomplished among the elements of the launch system 10. Bus 14 is coupled to a first launcher 16 and to a second launcher 18, and may also be coupled to other launchers, not illustrated. Launchers 16 and 18 may be identical. Each launcher includes M modules, where M is an integer such as eight. Each launcher module includes a plurality of module cells (MC), each of which is associated with at least one missile. In FIG. 1*a*, module 20 of first launcher 16 contains eight module cells MC, each of which is connected to bus 14. The eight module cells of launcher module 20 are designated 50*a*, 50*b*, 50*c*, 50*d*, 50*e*, 50*f*, 50*g*, and 50*h*. Each module cell is associated with one location (designated together as 51) from which missiles can be launched from a canister or container, so each module cell 50*a*, 50*b*, 50*c*, 50*d*, 50*e*, 50*f*, 50*g*, and 50*h* correspond to a location 51*a*, 51*b*, 51*c*, 51*d*, 51*e*, 51*f*, 51*g*, and 51*h* from which a missile may be launched, and other corresponding module cells of launcher modules other than launcher module 20, corresponds to other locations from which one missile can be launched from a canister, or from which more than one module can be launched, if the canister contains multiple missiles. Module cell 20 includes a motor control panel (MCP) 28, and further includes two power supplies (PS) designated together as 29. Similarly, M module 22 of first launcher 16 contains eight module cells. Second launcher 16 also contains M modules, the first of which is designated 24, and the $M^{th}$ of which is designated 26. Each of the modules of the second launcher 18 contains eight module cells.

Figure 1B:
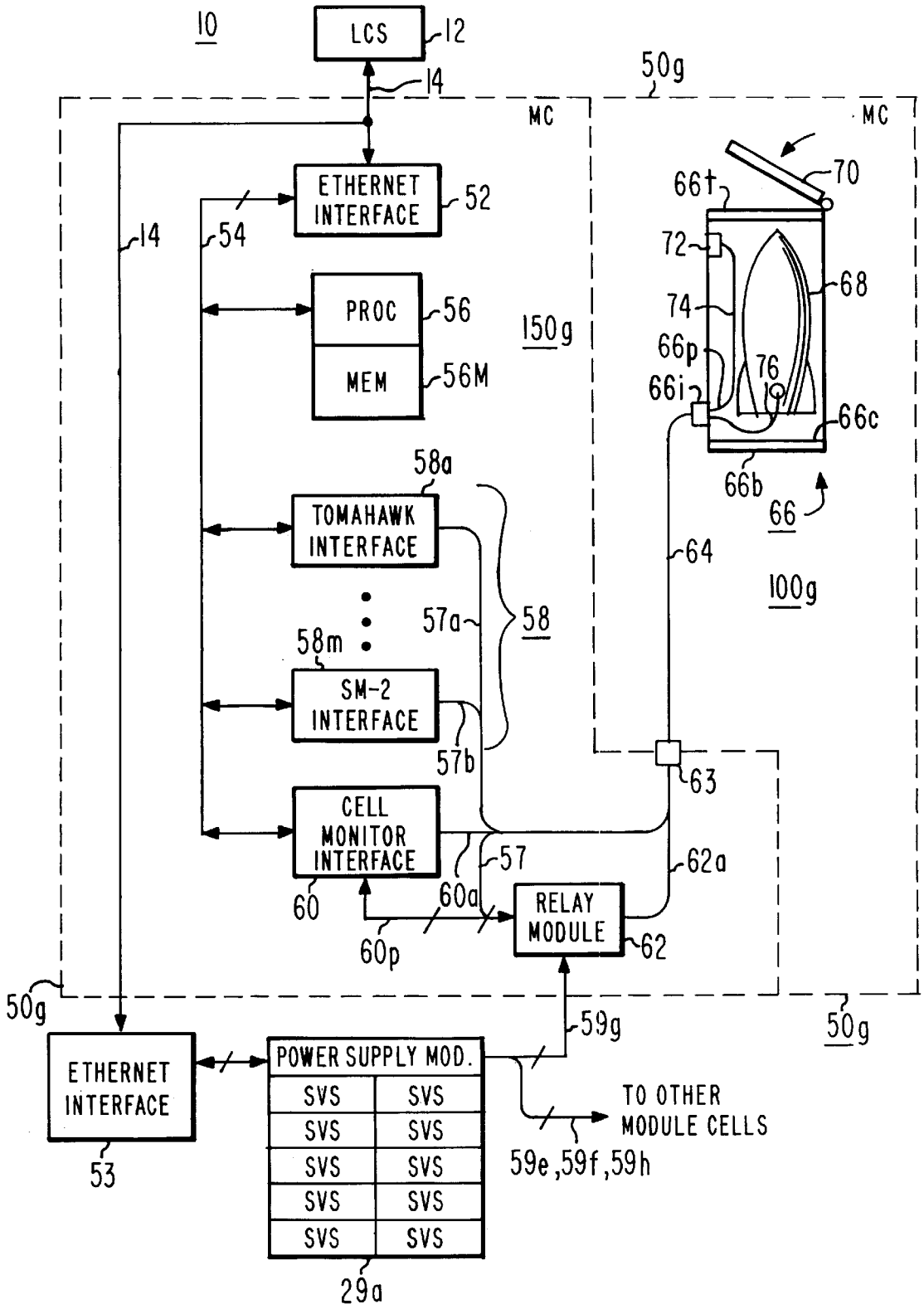
FIG. 1*b* is a simplified block diagram of a portion of the multi-missile launching arrangement of FIG. 1*a* including a portion of the first launcher, and including details of a module cell of a launcher module of the first launcher of FIG. 1*a*.

FIG. 1*b* is a simplified block diagram of a portion of multi-missile launching arrangement 10 including details of module cell 50*g* of launcher module 20 of first launcher 16 of FIG. 1*a*. In FIG. 1*b*, elements corresponding to those of FIG. 1*a* are designated by like reference numerals. The module cell 50*g* of FIG. 1*b* is therefore located at location 51*g* of FIG. 1*a* from which missiles may be launched from a canister. FIG. 1*b* shows that the module cell 50*g* is divided into two portions, namely an electronic portion which is designated fire-control unit 150*g*, and another portion, designated 100*g*, which includes the missile canister 66, and also includes associated parts including a movable hatch 70 and an umbilical cable 64 connecting the fire control unit 50*g* with other portion 100*g* of module cell 50*g*. As illustrated in FIG. 1*b*, bus 14 terminates within electronic portion 150*g* of module cell 50*g* in Ethernet transducers or converters 52 and 53. Ethernet interface 52 translates between serial signals on bus 14 and parallel signals on bus 54 internal to electronic portion 150*g* of module cell 50*g*. Bus 54 connects to a processor (PROC) 56, which is associated with a preprogrammed memory 56M. Bus 54 also connects to a plurality of conventional electronic cards designated generally as 58, some of which are illustrated as 58*a* and 58*m*. More particularly, an interface card suitable for use with a Tomahawk missile is illustrated as 58*a*, and an interface card suitable for use with an SM-2 anti-aircraft missile is illustrated as 58M. These interface cards convert between parallel data on bus 54 and the serial data in a format acceptable to the various missiles. A cell monitor 60 is also connected to bus 54, for purposes described below.

As mentioned above in connection with FIG. 1*b*, Ethernet bus 14 connects to a separate Ethernet interface 53 within electronic portion 150*g*, for providing communication between one of the two power supplies 29*a* and the various processors 56 of the eight module cells of each launcher 16, . . . 22. More particularly, one of the two power supplies designated 29 in FIG. 1*a* is represented as 29*a* in FIG. 1*b*. Power supply 29*a* has a plurality of different individual power supplies or switchable voltage sources (SVS) having different voltages or polarities. As illustrated in FIG. 1*b*, there are a total of ten such SVS in power supply 29*a*, but the number may be greater or less, as the missiles to be handled may require. Each of the individual switchable voltage sources produces a voltage which is suitable for use by one or more of the missiles which might be used by the multi-missile launching arrangement 10. For example, one of the SVS of power supply 29*a* might produce 24 volts positive with respect to reference, which might find use in all of the missiles, while another power supply might produce 28 volts negative, used by only one missile. Selection of a particular combination of SVSs of power supply 29*a* should provide any combination of voltage sources which any missile might require.

Also in FIG. 1*b*, portion 10*g* of module cell 50*g* includes a missile canister 66, represented as containing a single missile 68. Missile canister 66 includes a canister shell 66*c*, an upper frangible shield 66*t*, a lower frangible shield 66*b*, and a standardized canister connector, if desired) 66*i* which provides an electrical interface between the missile within the canister shell 66*c* and electrical elements without or outside of the canister shell 66*c*. Some of the pins of the standardized canister connector 66*i* are connected "internally" of the canister shell 66*c* in a manner which provides coded information as to the type of missile contained within canister 66. Such coding information is illustrated as being supplied by an internal wiring connection 74 connecting the appropriate pins of standardized canister connector 66*i* to a coding plug 72 which is not accessible from outside the canister 66.

A relay module 62 of electronic portion 150*g* of module cell 50*g* of FIG. 1*b* is connected by a parallel path 60*p* to a port of cell monitor/interface 60. The relays of relay module 62 are connected by way of power conduction paths 59 to the various switchable voltage sources (SVS) of power supply module 29*a*, and connect the various switchable voltage sources of power supply 29*a* to the pins of an umbilical interface connector 63. Umbilical interface connector 63 connects to the proximal end of an umbilical cable 64, which connects at its distal end to standardized canister connector 66*i*. Other parallel conduction paths designated as 59*e*, 59*f*, and 59*h* represent other connections of the various switchable voltage sources of power supply module 29*a* to the corresponding relay modules of other module cells 50*e*, 50*f*, and 50*h*, respectively, of first module 20 of first launcher 16 of FIG. 1*a*, so that power supply module 29*a* can provide power to the selected missiles of the four module cells 50*e*, 50*f*, 50*g*, and 50*h* of FIG. 1*a*. The corresponding other (not illustrated) of the two power supply modules 29 of FIG. 1*a* provides power to the remaining ones of the module cells, namely module cells 50*a*, 50*b*, 50*c*, and 50*d*.

In operation at turn-on of the arrangement of FIGS. 1*a* and 1*b*, the type of missile in each of the canisters is identified to the associated fire control unit by way of the coding of the standardized canister connector 66*i*. The coding is read by application of voltage to the coding jumpers, and reading the returned voltage by way of wires included in signal path 60*a*.

After the missiles have all been identified, the system remains in a fault monitoring mode until a command is given to the launch control system 12 by a human operator (or at least with his acquiescence) to arm a particular missile, whereupon the launch control system 12 selects one of the corresponding missiles for launch. The appropriate commands to arm the missile are sent from the launch control system by way of the bus 14 to the selected one of the fire control units, such as 150*g*, of the selected module cell 50*g*. At the module cell, the ethernet interface, such as interface 52 of FIG. 1*b*, converts the arming commands into parallel data on bus 54. These arming commands are applied to processor 56. Processor 56 responds by accessing memory 56M to determine the format of the arming commands for the particular type of missile located in its own module cell. These commands are applied over bus 54 to the corresponding one of the interface boards 58, as for example to board 58*m* of FIG. 1*b*. Board 58*m* then converts the parallel digital arming commands from the processor 56 into serial data in the format appropriate to the particular missile. The parallel data is applied over bus 54 to the relevant missile interface card (to one of cards 58), and is coupled by way of signal paths designated together as 57 to relay module 62, and are eventually coupled through umbilical 64 to the standardized canister connector, such as 66*i* of FIG. 1*b*. From the standardized canister connector, the commands are coupled to the missile by internal connections, such as those illustrated as 76 in FIG. 1*b*. The missile responds to those commands by returning appropriate confirmation signals.

Prior to, or concurrently with the arming of the missile, commands are sent from the [processor of the fire control unit of the selected one of the module cells, as for example from processor 56 of fire control unit 150*g* of module cell 50*g* of FIG. 1*b* to Ethernet interface 52] to motor command panel 28 of module cell 20, to open the particular hatch which covers the missile canister of the module cell. More particularly, processor 56 of FIG. 1*b* commands, by way of Ethernet interface 52 of FIG. 1*b*, and by way of bus 14 of FIGS. 1*a* and 1*b*, that motor control panel 28 of FIG. 1*a* open the hatch associated with missile canister 66 of FIG. 1*b*, which is in module cell 50*g* of FIG. 1*a*. Thus, the hatch is open at the time the missile is launched.

After the arming of the missile and the confirmation thereof, launch control system 12 of FIG. 1 may receive a "launch" or "fire" command. This command is immediately sent by way of bus 14 to the appropriate one of the fire control units of the selected module cell. The processor within that fire control unit interprets the fire command, and sends the translated command to the appropriate and then by way of the umbilical to the missile which then leaves the canister, breaking the frangible shields or guards 66*b* and 66*t*. Sensors (not illustrated) associated with the shields provide an indication of missile engine ignition (breaking of shield 66*b*) and missile away (breaking of shield 66*t*). These signals are then used by the processors of the multi-missile launching arrangement 10 to indicate that the missile is fired. Subsequent to launch the MCP 28 closes the cell hatch 70, and the module is ready to repeat the process.

The described system has the advantage that new types of missiles can be added to the list of those which can be handled and controlled, without reprogramming an entire launch sequencer. Such reprogramming may require extensive testing to assure that other capabilities of the sequencer have not been compromised by the program changes. Instead, it is only necessary to add a "card" to group 58, with an interpreter which is capable of adapting the parallel commands from processor 58 to the new missile type, and to add to memory 56M the coding of the standardized connector which identifies the new missile type. These relatively simple changes require a minimum of testing to verify operability.

Other embodiments of the invention will be apparent to those skilled in the art. For example, more launchers such as 16, 18 of FIG. 1*a* may be used to increase the number of missiles available for firing. Within each missile launcher 16, 18, more launcher modules 20, . . . , 22; 24, . . . , 26 may be used. Each launcher module, in turn, may have more or fewer module cells or launch locations such as 50*g*. Notably, each launch location or module cell which accommodates a canister may handle a canister which holds more than one missile, which can be separately launched. More power supplies may be used in each module 20, . . . , 22; 24, . . . , 26. Also, some types of missiles, notably the Tomahawk missile, require so much more start-up power than other missiles, and at different voltage levels, that it may be advantageous to have a separate, additional power supply in each module in order to supply the power for such missiles. The relays of the relay modules, such as module 62 of FIG. 1*b*, may contain conventional coil-and-movable-element relays, or they may contain solid-state relays, or a combination of conventional and solid-state relays, depending upon factors such as the reliability required, the number of expected operations, the current level carried, and the like. While the FIGURES illustrate certain groupings of electrical elements as being within certain functional modules, this grouping does not imply that the electrical elements are physically located within an enclosure or otherwise physically co-located as schematically depicted. Thus, the power supply, the motor control panel, and the fire control units may be physically repackaged as may be necessary to suit a particular customer requirement, while retaining the same basic system operation. Similarly, the use of terms such as "card" or "module" does not necessarily indicate a physically separable portion of the system.

Thus, a missile launching arrangement (10) according to the invention is capable of launching a plurality of missile types (Tomahawk and SM-2, for example). Each of the missiles is loaded into a canister (66) which has a standardized canister connector (66*i*). The standardized canister connector (66*i*) includes pins (66*p*) which are jumpered (by conductors 74 and coding plug 72) in a manner which provides coding information identifying the type(s) of missile within the canister (66). The canister connector (66*i*) also includes pins (66*p*) which provide a path (76, 66*p*) for the flow of signals between the missile (68) in the canister (66) and the outside world. The missile launching arrangement (10) includes a computerized launch control system (12) for maintaining an inventory of the multiple missile types which are available to the missile launching arrangement, and which, in response to external commands from a weapons control system, generates commands which identify the type of missile to be launched, and also generates missile launch preparation or arming commands and missile launch commands. The arrangement according to the invention also includes a plurality of missile launch locations (51*a*, 51*b*, 51*c*, 51*d*, 51*e*, 51*f*, and 51*h*, associated with each of module cells 50*a*–50*h*, and with other corresponding module cells), each of which is capable of holding one of the missile canisters (66) of any of the plurality of types of missiles. A power supply module (29*a*) [is associated with each of the missile launch locations] is associated with each of the module cells (20, . . . , 22; 24, . . . 26), and each of the power supply modules (29*a*) includes a plurality of switchable voltage sources (SVS). A fire control unit (150*g*) is associated with each one of the missile launch locations (51*a*, 51*b*, 51*c*, 51*d*, 51*f*, 51*g*, and 51*h*). Each of the fire control units (150*g*) includes an electronics module (52, 54, 56, 56M, 58*a*, . . . , 58*m*, 60) and a relay module (62). The electronics module (52, 54, 56, 56M, 58*a*, . . . , 58*m*, 60) and the relay module (62) of each fire control unit (150*g*) are connected by continuous electrically conductive paths (63, 64) to the standardized canister connector (66*i*) of that one of the canisters (66) associated with the particular one of the missile launch locations (51*g*) with which the fire control unit (150*g*) is associated. The electronics module (52, 54, 56, 56M, 58*a*, . . . . 58*m*, 60) of the fire control unit (150*g*) is also connected to the launch control system (12) and to the associated one of the relay modules (62). Each one of the relay modules (66, and others in other launcher modules such as 20, . . . , 22; 24, . . . , 26) is also connected to each one of (to all of) the switchable voltage sources (SVS) of that one of the power supply modules associated with the associated one of the [missile launch locations] launcher modules (20, . . . , 22; 24, . . . , 26), for coupling the voltages of a selected set of the switchable voltage sources (SVS) to the standardized canister connector (66*i*) of that one of the missile canisters (66) located in the associated one of the missile launch locations (51*a*, 51*b*, 51*c*, 51*d*, 51*e*, 51*f*, 51*g*, 51*h*). The set of voltages which is coupled may be the voltage of only one of the voltage sources (SVS), if appropriate to the missile type. Each one of the electronics modules (52, 54, 56, 56M, 58, 60) includes a memory arrangement (56M) preloaded with information relating to a plurality of individual types of missiles. The electronics module (52, 54, 56, 56M, 58, 60) performs a comparison of the memorized information with the coding (provided by conductors 74 and coding plug 72) of that one of the standardized canister connectors (66*i*) associated with that one of the missile canisters (66) associated with the associated missile launch location (51*g*), for identifying the type of missile contained therein, and for communicating the type of missile so identified to the launch control unit (12). Each one of the fire control units (150*g*) also responds to arming and firing commands from the launch control unit (12) directed to the one (150*g*) of the fire control units, by producing, with the aid of that preprogrammed memory (56M) associated with its electronics module (52, 54, 56, 56M, 58, 60), a sequence of corresponding arming and firing commands appropriate to the particular missile type identified by the coding of the standardized canister connector (66*i*). The corresponding arming and firing commands are coupled to the standardized canister connector (66*i*) of that one of the canisters (66) associated with the associated missile launch location (51*g*). In a particular embodiment of the invention, the switchable voltage sources (SVS) of that one of the power supply modules (62) associated with a particular one of the missile launch locations (51*g*) are controllable (by way of interface 52, Ethernet bus 14, and interface 53) from the electronics module (52, 54, 56, 56M, 58, 60) of the fire control unit (150*g*) associated with the same one of the missile launch locations (51*g*). In this embodiment, the switchable voltage sources are controllable over a local area network (52, 14, 53) which includes the corresponding one of the fire-control units (the fire control unit is connected thereto).

What is claimed is:

1. A missile launching arrangement which is capable of launching a plurality of missile types, each of said missiles being loaded into a canister which has a standardized canister connector, which standardized canister connector includes pins which are jumpered in a manner which provides coding information identifying the type of missile within the canister, and also includes pins which provide a path for the flow of signals between the missile in the canister and the outside world, said missile launching arrangement comprising:

a launch control system for maintaining an inventory of multiple missile types, and which, in response to external commands from a weapons control system, generates commands which identify the type of missile to be launched, and which also generates missile launch preparation commands and missile launch commands;

a plurality of missile launch locations, each of which is capable of holding one of said missile canisters;

a power supply module associated with at least one of said missile launch locations so that each of said missile launch locations has assigned to it at least one of said power supply modules, each of said power supply modules including a plurality of switchable voltage sources;

a fire control unit associated with each one of said missile launch locations, each of said fire control units including an electronics module and a relay module, said electronics module and said relay module being connected by continuous electrically conductive paths to said standardized canister connector of that one of said canisters associated with the particular one of said missile launch locations with which said fire control unit is associated, said electronics module of said fire control unit also being connected to said launch control system and to the associated one of said relay modules, and each one of said relay modules also being connected to each of said switchable voltage sources of that one of said power supply modules associated with said associated one of said missile launch locations, for coupling the voltages of a selected set of said switchable voltage sources, which set may include only one switchable voltage source, to said standardized canister connector of that one of said missile canisters located in said associated one of said missile launch locations, each one of said electronics modules including a memory arrangement preloaded with information relating to a plurality of individual types of missiles, said electronics module being for performing a comparison of said coding of that one of said standardized canister connectors associated with that one of said missile canisters associated with said associated missile launch location, for identifying the type of missile contained therein, and for communicating said type of missile so identified to said launch control unit, each one of said fire control units also responding to arming and firing commands from said launch control unit directed to the one of said fire control units by producing, with the aid of that preprogrammed memory associated with its electronics module, a sequence of corresponding arming and firing commands appropriate to the particular missile type identified by the coding of said standardized canister connector, and for coupling said corresponding arming and firing commands to said standardized canister connector of that one of said canisters associated with the associated missile launch location.

2. An arrangement according to claim 1, wherein said switchable voltage sources of that one of said power supply modules associated with a particular one of said missile launch locations are controllable from said electronics module of said fire control units associated with the same one of said missile launch locations.

3. An arrangement according to claim 1, further comprising:

a movable hatch associated with each of said missile cells, which movable hatch normally covers the end of said canister from which said missile emerges when launched;

motor control means associated with a selected group of said missile launch locations, for independently controlling the postions of said hatches of said missile launch locations of said selected group of missile launch locations, said motor control means being controllable by said electronics module of said fire control units associated with said selected group of missile launch locations.

4. A system according to claim 3, wherein said control of said motor control means is provided by a local area network.

5. A missile launching arrangement which is capable of launching a plurality of missile types, each of said missiles being loaded into a canister which has a, standardized canister connector, which standardized canister connector includes pins which are jumpered in a manner which provides coding information identifying the type of missile within the canister, and also includes pins which provide a path for the flow of signals between the missile in the canister and the outside world, said missile launching arrangement comprising:

a launch control system which, in response to external commands from a weapons control system, generates commands which identify the type of missile to be launched, and which also generates missile launch preparation commands and missile launch commands;

a plurality of missile launch locations grouped into sets, each of which missile launch locations is capable of holding one of said missile canisters;

a power supply module associated with each of said sets of said missile launch locations, so that each of said missile launch locations has assigned to it at least one of said power supply modules, each of said power supply modules including a plurality of switchable voltage sources;

a fire control unit associated with each one of said missile launch locations, each of said fire control units including an electronics module and a relay module, said electronics module and said relay module being connected by continuous electrically conductive paths to said standardized canister connector of that one of said canisters associated with the particular one of said missile launch locations with which said fire control unit is associated, said electronics module of said fire control unit also being coupled to said launch control system and to the associated one of said relay modules, and each one of said relay modules also being connected to each of said switchable voltage sources of that one of said power supply modules associated with the associated one of said sets of missile launch locations, for coupling the voltages of a selected set of said switchable voltage sources, which set of said switchable voltage sources may include only one switchable voltage source, to said standardized canister connector of that one of said missile canisters located in said associated one of said missile launch locations, each one of said electronics modules including a memory arrangement preloaded with information relating to a plurality of individual types of missiles, said electronics module being for performing a comparison of said coding of that one of said standardized canister connectors associated with that one of said missile canisters associated with said associated missile launch location, for identifying the type of missile contained therein, and for communicating said type of missile so identified to said launch control unit, each one of said fire control units also responding to arming and firing commands from said launch control unit directed to the one of said fire control units by producing, with the aid of that preprogrammed memory associated with its electronics module, a sequence of corresponding arming and firing commands appropriate to the particular missile type identified by the coding of said standardized canister connector, and for coupling said corresponding arming and firing commands to said standardized canister connector of that one of said canisters associated with the associated missile launch location.

6. A system according to claim 5, wherein said electronics module of each of said fire control units is coupled to said launch control system by means of a local area network.

7. A system according to claim 6, wherein said local area network comprises an Ethernet network.

* * * * *